US012630975B2

(12) United States Patent
Singh et al.

(10) Patent No.: US 12,630,975 B2
(45) Date of Patent: May 19, 2026

(54) PROCESS FOR TREATMENT OF BIOMASS FOR PULPING AND BIOREFINERY APPLICATIONS

(71) Applicant: FUMA LABS PRIVATE LIMITED, Gwalior (IN)

(72) Inventors: Shubham Singh, Gwalior (IN); Abhishek Dhobe, Gwalior (IN)

(73) Assignee: FUMA LABS PRIVATE LIMITED, Gwalior (IN)

( * ) Notice: Subject to any disclaimer, the term of this patent is extended or adjusted under 35 U.S.C. 154(b) by 157 days.

(21) Appl. No.: 18/696,120

(22) PCT Filed: Sep. 26, 2022

(86) PCT No.: PCT/IN2022/050859
§ 371 (c)(1),
(2) Date: Mar. 27, 2024

(87) PCT Pub. No.: WO2023/047423
PCT Pub. Date: Mar. 30, 2023

(65) Prior Publication Data

US 2024/0401270 A1 Dec. 5, 2024

(30) Foreign Application Priority Data

Sep. 27, 2021 (IN) ..... 202121043719

(51) Int. Cl.

| | |
|---|---|
| ***D21C 3/26*** | (2006.01) |
| ***D21C 1/00*** | (2006.01) |
| ***D21C 3/20*** | (2006.01) |
| ***D21H 11/12*** | (2006.01) |

(52) U.S. Cl.
CPC ..... *D21C 3/26* (2013.01); *D21C 1/00* (2013.01); *D21C 3/20* (2013.01); *D21H 11/12* (2013.01)

(58) Field of Classification Search
CPC ..... D21C 3/26; D21C 1/00; D21C 3/20; D21H 11/12
See application file for complete search history.

(56) References Cited

FOREIGN PATENT DOCUMENTS

| | | | | |
|---|---|---|---|---|
| CA | 2368872 A1 * | 4/2000 | ..... | D21C 1/02 |
| EP | 1190137 B1 | 11/2003 | | |
| JP | 2019129771 A | 8/2019 | | |
| KR | 101526439 B1 | 6/2015 | | |

(Continued)

OTHER PUBLICATIONS

Mohammadi-Rovshandeh et al., "Pulping of Rice Straw by High Boiling Solvents in Atmospheric Pressure", Iranian Polymer Journal, 14 (3), pp. 223-227 (2005).

(Continued)

*Primary Examiner* — Anthony Calandra
(74) *Attorney, Agent, or Firm* — HSML P.C.

(57) ABSTRACT

The present disclosure relates to a process for treatment of biomass, specifically for pulping and biorefinery applications. The process relates to an organosolv process using high boiling organic solvents for the extraction of high molecular weight lignin and other products from the solution of pulping liquor, by using recycled liquor as the white liquor for pulping. The disclosure also relates to byproducts of pulp & paper industry such as lignin. C5 & C6 sugars.

12 Claims, 1 Drawing Sheet

(56) References Cited

FOREIGN PATENT DOCUMENTS

| | | | | |
|---|---|---|---|---|
| WO | WO-2019112428 A1 * | 6/2019 | ..... | B65D 85/324 |
| WO | WO-2022251873 A1 * | 12/2022 | ..... | D21H 11/12 |

OTHER PUBLICATIONS

Dimitrios K. Sidiras and Ioanna S. Salapa, "Organosolv Pretreatment as a Major Step of Lignocellulosic Biomass Refining", Biorefinery I: Chemicals and Materials From Thermo-Chemical Biomass Conversion and Related Processes, 9 pages, available online at: http://dc.engconfintl.org/biorefinery_I/18 (2015).

International Search Report and Written Opinion, International Patent Application No. PCT/IN2022/050859, Dec. 23, 2022 (9 pages).

Yu et al., "Understanding the Effects of Ethylene Glycol-Assisted Biomass Fractionation Parameters on Lignin Characteristics Using a Full Factorial Design and Computational Modeling", ACS Omega 2019, 4, 16103-16110.

Examination report, IN patent application No. 202121043719, Apr. 18, 2023 (6 pages).

* cited by examiner

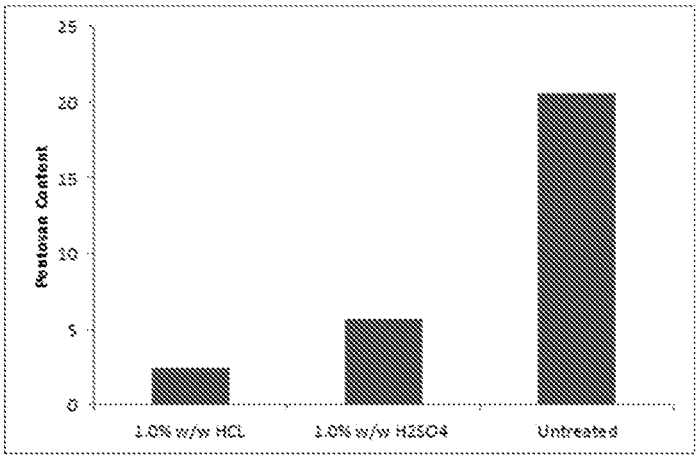
25
20
15
10
5
0
Pentosan Content
1.0% w/w HCL
1.0% w/w H2SO4
Untreated

PROCESS FOR TREATMENT OF BIOMASS FOR PULPING AND BIOREFINERY APPLICATIONS

FIELD OF THE INVENTION

The present disclosure relates to a process for treatment of biomass, specifically for pulping and biorefinery applications. The process is useful for recovering Lignin, Pulp and C5 sugars isolated from the biomass with improved yield and performance.

BACKGROUND AND PRIOR ART

Pulp & paper is manufactured using kraft, sulfite process, which is water intensive, and requires chemicals which are expensive to recover. Most small & pulp manufacturers could not afford effluent treatment plants and release toxic effluents into water bodies. On the other hand thermo-mechanical Pulping (TMP) is highly energy intensive and the paper product of lower quality is produced. Most small pulp manufacturers could not afford effluent treatment plants and released the toxic effluents into water bodies.

Further byproducts of the pulp & paper industry such as lignin, C5 & C6 sugars have not been utilized to its full commercial potential. Pulping of agricultural waste has remained a challenge especially of crops such as wheat, rice which have high silica content. This silica goes into the pulping liquor and builds up creating problems such as fouling of equipment in further treatment steps making it expensive.

A number of processes in the prior art process for treatment of biomass is known, however, most of them suffer from drawbacks such as higher cooking time, temperature of reaction is higher, poor-quality, pulp for paper or packaging application, higher separation cost etc.

For example, Mohammadi-Rovshandch, J. et al. "Pulping of Rice Straw by High Boiling Solvents in Atmospheric Pressure." (2005) discuss high boiling solvent pulping at atmospheric pressure without any recycling arrangement making as well as higher cooking time, the properties observed in the paper are not in agreement with other literature available for the given material processed under same operating condition.

Similarly, Sidiras, Dimitrios K. et. al. "Organosolv pretreatment as a major step of lignocellulosic biomass refining." (2015) explores the pathways of producing value added products through fractionation of lignocellulosic biomass. The treatment conditions are heavily water intensive as the slurry consistency is taken to be 1:20. The liquor uses H2SO4 as catalyst which leads to problem of lignin quality. The temperature of reaction is higher at which hemicellulose degradation is faster because of H+ ions in H2SO4 leading to poor quality pulp for paper or packaging application.

The process of the present invention overcomes the drawbacks of the process disclosed in the prior art in an economically viable manner. The present disclosure addresses one or more problems as discussed above and other problems associated with the process for treatment of biomass, specifically for pulping and biorefinery applications.

The present disclosure has overcome issues associated with the process for treatment of biomass by using high boiling organic solvents as the pulping medium for crop waste-based biomass. The process solves the problem of economic viability of organosolv process using high boiling organic solvents as well as subsequent extraction of high molecular weight lignin from the solution of pulping liquor, by using recycled liquor as the white liquor for pulping. In the condition of processing no silica was found in the liquor making it easier for recycling as well as high molecular weight lignin separation without impurities.

SUMMARY OF THE INVENTION

The present disclosure relates to a process for treatment of biomass, specifically for pulping and biorefinery applications. The process relates to an organosolv process using high boiling organic solvents for the extraction of high molecular weight lignin and other products from the solution of pulping liquor, by using recycled liquor as the white liquor for pulping.

Accordingly, the first objective of this invention is to provide a process for treatment of biomass.

Another objective of the invention is to provide Lignin, Pulp and C5 sugars isolated from the biomass with improved yield.

The process uses $\frac{1}{3}^{rd}$ less water in comparison to conventional processes. Further, byproducts such as lignin are extracted in low molecular weight condition and 100% silica goes into the pulp rather than the effluent thereby increasing the efficiency of the process. Thus, the process is specifically useful for silica rich fibers and therefore is environmentally friendly and cost effective.

BRIEF DESCRIPTION OF FIGURES

FIG. 1: Comparison of pentosan content reduction by pretreatment with 1.0% w/w HCl and 1.0% w/w H2SO4

DETAILED DESCRIPTION

While the invention is susceptible to various modifications and alternative forms, specific aspect thereof has been shown by way of example and will be described in detail below. It should be understood, however that it is not intended to limit the invention to the particular forms disclosed, but on the contrary, the invention is to cover all modifications, equivalents, and alternatives falling within the spirit and the scope of the invention.

The Applicants would like to mention that the examples are mentioned to show only those specific details that are pertinent to understanding the aspects of the present invention so as not to obscure the disclosure with details that will be readily apparent to those of ordinary skill in the art having benefit of the description herein.

The terms "comprises", "comprising", or any other variations thereof, are intended to cover a non-exclusive inclusion, such that a composition or process that comprises a list of components does not include only those components but may include other components not expressly listed or inherent to such process. In other words, one or more elements in a composition, system or process proceeded by "comprises . . . a" does not, without more constraints, preclude the existence of other elements or additional elements in the system or process.

The present disclosure relates to a process for the treatment of biomass, specifically for pulping and biorefinery applications.

Accordingly, one aspect of the present disclosure relates to process for the treatment of biomass comprises the following steps:

a. sizing of biomass followed by pre-treatment or optionally soaking and then pre-treating biomass in a first reaction vessel,
b. the pre-treated biomass material of step (a) is squeezed and washed to remove a liquor 'A' followed by cooking in a second reaction vessel using a high boiling solvent to provide a pulp,
c. the pulp obtained in step (b) is squeezed and washed using hot high boiling solvent in a counter current fashion to provide a black liquor,
d. the black liquor obtained in step (c) is diluted to precipitate lignin out and separating the supernatant liquor 'B',
e. the liquor 'B is collected and concentrated using an evaporator followed by recycling the liquor 'B' to the reaction vessel of step (b) for cooking of the pre-treated biomass along with high boiling solvent.

In one of the embodiments, the biomass consists mainly of crop residue like rice straw, wheat straw, husk, etc. individually or as a blend.

In one of the embodiments, the biomass is washed for dirt and other impurities and then cut using a regular size chaff cutter preferably up to 1.5 to 2.5 cm size range.

In one of the embodiments, the sized biomass is fed to a tank, in which soaking is done with the help of alkali, acid or organic solvent.

In one of the embodiments, the solid to liquid ratio for soaking is maintained at a range of 1:5 to 1:15, preferably 1:10.

In one of the embodiments, the soaking is organosolv soaking wherein the softening of biomass was not much hence paper mat could not be formed for testing.

In one of the embodiments, the soaking step involves a further intermediate step wherein biomass material is squeezed and washed to remove the liquor 'A'. The liquor 'A' is acidic or basic based on the soaking treatment and can be used for further processing steps. The liquor generated can be carried forward to the next processing step and given thermal treatment, but the experimental conditions yield only degraded to sugars hence not favourable for paper making application.

In one of the embodiments, the pretreatment of biomass is done using hot water (Autohydrolysis) after soaking or without soaking by feeding the biomass to the contacting vessel along with hot water.

In one of the embodiments, the autohydrolysis is done in the ratio of 1:6 or 1:10 solid to liquid ratio for biomass and hot water respectively and heating at the temperature range of 120 to 200° C., preferably below 150° C.

In one of the embodiments, the pre-treatment removes mostly hemicelluloses.

In another embodiments, dilute acidic solutions are used for pre-treatment of soaked biomass.

In one of the embodiments, 1.0% HCL soaking followed by 1.0% HCl pre-treatment degrades total biomass into sugars, precipitating out lignin involves a further intermediate step wherein in autogenous conditions (The pressure generated automatically in the reactor system due to vapour formation without external steaming or purging operation).

In one of the embodiments, the pre-treatment of the biomass is squeezed and washed to remove the liquor before the cooking step. The liquor can be used in further processing having comparatively lower pH due to presence of carboxylic acids.

In one of the embodiments, the biomass subsequent to soaking or pre-treatment is cooked in a high boiling solvent, wherein the high boiling solvent is preferably selected form di-ethylene glycol (DEG) or ethylene glycol (EG).

In one of the embodiments, the biomass subsequent to soaking or pre-treatment is cooked in a recycled stream based on liquor 'A' or liquor 'B'.

In one of the embodiments, the soaked and/or pretreated biomass material is fed to the reaction vessel maintaining a 1:6 solid to liquid ratio wherein the liquid contains a particular ratio of high boiling solvent to water ranging from 50:50 to 100:00 and at higher temperature ranging from 140 to 200° C.

In one of the embodiments, the soaked and/or pretreated biomass material is fed to the reaction vessel maintaining a 1:6 solid to liquid ratio wherein the liquid contains recycled stream based on liquor 'A' or liquor 'B'.

In one of the embodiments, the soaked and/or pretreated biomass material is fed to the reaction vessel maintaining a 1:6 solid to liquid ratio wherein the liquid contains recycled stream based on liquor 'B' comprising DEG:Water:HMF: Furfural: 50:48:1:2.

In one of the embodiments, the pulp obtained from the cooking step is squeezed and washed using hot high boiling solvent in a countercurrent fashion to provide a black liquor.

In one of the embodiments, the black liquor is diluted to precipitate lignin out and separating the supernatant liquor 'B' which is collected and concentrated using an evaporator.

In one of the embodiments, supernatant liquor 'B' is stored in an intermediate tank for the next scheduled batch or is recycled to the cooking reaction vessel.

In yet another embodiment, the process comprises the following steps:

1. The sized biomass is fed to the reactor and pre-treatment is carried out in the reactor, the water is then drained from the reactor and the biomass is retained in the reaction vessel.
2. The pretreated biomass is then fed with the recycled liquor for pulping and the temperature is elevated to process parameters.
3. The temperature is maintained for a stipulated amount of time.
4. After the processing is done the reaction vessel is evacuated and the material is transferred to a hot water washer.
5. The liquor is separated in washing and the pulp is separated out.
6. The liquor is then sent to decanter to separate lignin and the liquor is separated leaving us with liquor.
7. The liquor is stored in an intermediate tank till the next scheduled batch is planned.
8. When the start of the next batch, the liquor is then concentrated using an evaporator and is fed to the reactor.

In yet another embodiment of the present disclosure relates to byproducts of pulp & paper industry such as lignin, C5 & C6 sugars.

Another embodiment of the present disclosure relates to a molded product comprising the pulp obtained from the process of the present invention.

In one of the embodiments, the molded product is a packaging product.

Further salient features of the process for the treatment of biomass are discussed in the examples provided below.

EXAMPLES AND EXPERIMENTAL METHODS

Comparative Example 1: Process for Treating Biomass

Sizing of Biomass

The Biomass which consists mainly of Crop residue like rice straw, wheat straw, husk, etc. individually or as a blend is washed for dirt and other impurities and then cut using a regular size chaff cutter preferably up to 1.5-2.5 cm size range. The sized biomass is then proceeded to further processing.

Soaking (Optional Step)

The sized biomass is then fed to a tank, in which soaking is done with the help of alkali, acid or organic solvent at various concentrations, the solid to liquid ratio is maintained at a range of 1:5 to 1:10. It is found 1:10 gives better results and better contact in preliminary experimentation.

Table 1 shows the experimental condition for soaking, while the alkali soaking nearly softened the biomass, the acid degraded the cellulose hence the binding was sub-par, the paper mesh couldn't be formed in such cases. Similar to that in case of organosolv soaking the softening of biomass was not much hence paper mat couldn't be formed for testing.

The paper needs hemicellulose as well as cellulose while binding and without cooking with alkali in these particular conditions with acids there is not enough softening of fiber making them unable to bind to each other while forming paper sheets. The acid removes a lot of hemicelluloses and degrades cellulose making the fiber fragile.

TABLE 1

Properties of pulp after soaking step

| Component | Concentration (%) | Temperature | Time | Kappa Number | Pentosan | Burst Index | Tensile Index | Tear Index |
|---|---|---|---|---|---|---|---|---|
| NaOH | 10-40 | NTP | 1440 | 49.32-33.34 | 11.58-8.6 | 4.5-3.8 | 8.3-7.9 | 13.0-13.0 |

NTP: Normal temperature pressure

The biomass material of the soaking step is further squeezed and washed to remove the liquor.

The liquor is acidic or basic based on the soaking treatment given. The liquor can be reused in further processing steps.

Pretreatment

The pretreatment step involves one or both of the following steps:

1) Autohydrolysis (Hot Water)

The Biomass after soaking or without soaking can be fed to the contacting vessel with water in a certain bath ratio of 1:6 or 1:10 and heated at the range of 120-200° C. but after 150° C. the biomass starts hydrolysis resulting in yield loss and property loss.

Table 2 shows data of "only pretreatment" stage without soaking since pretreatment just removes mostly hemicelluloses, the binding is not very good hence paper formed didn't have measurable properties hence Burst, Tensile or Tear Data is not available.

When the biomass is pretreated with acid, water, the final product is biomass with more porous structure and lesser hemicellulose content than the original feed. Still in these particular conditions the biomass is not softened enough to form paper efficiently, the biomass partly retains its original structure and the paper couldn't be formed without further mechanical treatment.

TABLE 2

Properties of pulp after "only pretreatment" stage without soaking

| Component | Bath | Concentration | Temperature | Time | Kappa Number | Lignin(%) | Pentosan |
|---|---|---|---|---|---|---|---|
| Water | 1:10 | 100 | 130 | 90 | 42 | 5.46 | 10.48 |
| Water | 1:10 | 100 | 120 | 90 | 44 | 5.72 | 11.23 |
| Water | 1:10 | 100 | 140 | 90 | 38 | 4.94 | 10.1 |
| Water | 1:10 | 100 | 150 | 90 | 34.5 | 4.485 | 8.15 |
| Water | 1:6 | 100 | 130 | 90 | 48.1 | 6.253 | 11.13 |
| Water | 1:6 | 100 | 120 | 90 | 48.5 | 6.305 | 13.5 |
| Water | 1:6 | 100 | 140 | 90 | 47.5 | 6.175 | 12.1 |
| Water | 1:6 | 100 | 150 | 90 | 46.9 | 6.097 | 11.56 |

2) Acid Hydrolysis

Similar to autohydrolysis but instead of water, dilute acidic solutions are used for pretreatment of soaked biomass.

Table 3 shows the biomass treatment without soaking at 120° C. at 1:6 solid to liquid ratio autogenous pressure.

TABLE 3

Properties of pulp after Acid hydrolysis

| Treatment | Pentosan % after Treatment |
|---|---|
| Untreated | 20.47% |
| 1.0% w/w HCL 30 min | 2.46% |
| 1.0% w/w H2SO4 30 min | 5.63% |

It can be seen from FIG. 1 that 1.0% HCL Soaking followed by 1.0% HCl pretreatment degrades total biomass into sugars, precipitating out lignin in autogenous conditions, which is unfavorable for pulping applications.

The biomass material after pretreatment step is squeezed and washed to remove the liquor. The liquor can be used in further processing having comparatively lower pH due to presence of carboxylic acids.

Cooking

After soaking and pretreatment or only pretreatment, the biomass is cooked in a high boiling solvent which in this case is di-ethylene glycol or ethylene glycol or liquor from recycled stream with other components.

The biomass material is cooked in a pressure vessel the pretreated material is fed to the vessel maintaining a 1:6 solid to liquid ratio where the liquid contains a particular ratio of solvent to water ranging from 50:50 to 100:00 and at higher temperature ranging from 140 to 200° C.

TABLE 4

| Properties of pulp after "only cooking" | | | | | | | |
|---|---|---|---|---|---|---|---|
| Component | S:L | Concentration | Temperature | Time | Kappa Number | Lignin(%) | Pentosan |
| DEG | 1:6 | 50 | 160 | 90 | 24.50 | 3.18 | 9.45 |
| DEG | 1:6 | 100 | 160 | 90 | 24.50 | 3.18 | 9.45 |
| DEG | 1:6 | 50 | 120 | 90 | 42.00 | 5.46 | 11.63 |
| DEG | 1:6 | 100 | 120 | 90 | 38.50 | 5.01 | 9.65 |
| EG | 1:6 | 50 | 120 | 90 | 33.3 | 4.33 | 10.20 |
| EG | 1:6 | 100 | 120 | 90 | 27.5 | 3.58 | 7.9 |
| EG | 1:6 | 50 | 160 | 90 | 22.5 | 2.93 | 6.30 |
| EG | 1:6 | 100 | 160 | 90 | 19.6 | 2.55 | 3.2 |

The effect of temperature and concentration and pulping solvent either EG or DEG on the properties of pulp can be seen the above table.

TABLE 5

| Properties of paper formed by pulp obtained from Table 4 conditions | | | | | | | |
|---|---|---|---|---|---|---|---|
| Component | S:L | Concentration | Temperature | Time | Burst Index | Tensile Index | Tear Factor |
| DEG | 1:6 | 50 | 160 | 90 | 4.1 | 13.2 | 14.1 |
| DEG | 1:6 | 100 | 160 | 90 | 4.30 | 11.20 | 13.50 |
| DEG | 1:6 | 50 | 120 | 90 | 3.80 | 9.60 | 16.20 |
| DEG | 1:6 | 100 | 120 | 90 | 2.90 | 12.30 | 15.20 |
| EG | 1:6 | 50 | 120 | 90 | 4.8 | 14.7 | 14.7 |
| EG | 1:6 | 100 | 120 | 90 | 4.3 | 13.7 | 12.9 |
| EG | 1:6 | 50 | 160 | 90 | 4.10 | 11.20 | 15.40 |
| EG | 1:6 | 100 | 160 | 90 | 3.80 | 11.30 | 15.90 |

The biomass material of the soaking step is further treated with recycled liquor instead of fresh DEG:Water: 50:50 we use DEG:Water:HMF:Furfural: 50:48:1:2.

The pulp is squeezed and washed using hot high boiling solvent (HBS) in a countercurrent fashion. The black liquor thus obtained is diluted to precipitate lignin out. The HBS contains HMF and Furfural, the liquid can be directly recycled in cooking operations. The lignin separated liquor is flashed to evaporate water up to a particular HBS to water ratio.

Optimization of the Process Conditions

Pretreatment+Cooking

In this process the biomass is fed to the contacting equipment and with hot water it is pretreated with certain conditions. The water is them drained from the contacting vessel and high boiling solvent fed to the reactor.

The HCL, $H_2SO_4$ pretreatment is omitted as the pretreatment is resulted in near complete hydrolysis leading to little to no fiber content in the biomass sludge.

Hence Autohydrolysis is selected as the pretreatment step followed by organosolv treatment.

TABLE 6

| Pretreatment | | | Cooking | | | | | | | | | |
|---|---|---|---|---|---|---|---|---|---|---|---|---|
| Component | Temperature | Time | Component | S:L | Concentration | Temperature | Time | Kappa Number | Pentosan | Burst Index | Tensile Index | Tear Index |
| Water | 130 | 90 | DEG | 1:06 | 50 | 120 | 90 | 39.8 | 5.7 | 5.4 | 5 | 2.8 |
| Water | 140 | 90 | DEG | 1:06 | 50 | 120 | 90 | 30.75 | 4.66 | 5.2 | 5.2 | 2.6 |
| Water | 130 | 90 | DEG | 1:06 | 50 | 160 | 90 | 42 | 7.9 | 3.8 | 2.9 | 2.5 |
| Water | 140 | 90 | DEG | 1:06 | 50 | 160 | 90 | 33.5 | 6 | 3.8 | 2.9 | 2 |
| HCl | 130 | 90 | DEG | 1:06 | 50 | 160 | 90 | 39.8 | 2.3 | 4.3 | 1.8 | 2.1 |

TABLE 7

| Soaking | | | | | Pretreatment | | | | | | | |
|---|---|---|---|---|---|---|---|---|---|---|---|---|
| Component | S:L | Time (min) | Kappa Number | Pentosan | Component | S:L | Concentration | Temperature | Time | Kappa Number | Lignin(%) | Pentosan |
| HCL | 1:10 | 1440 | 42.6 | 7.91 | Water | 1:10 | 100 | 130 | 90 | 35.6 | 4.628 | 8.95 |

TABLE 7-continued

| | Cooking | | | | | | | | | |
|---|---|---|---|---|---|---|---|---|---|---|
| | Component | S:L | Concentration | Temperature | Time | Kappa Number | Pentosan | Burs Index | Tensile Index | Tear Index |
| | DEG | 1:6 | 0.5 | 140 | 90 | 19.2 | 2.496 | 4.09 | 2.67 | 1.00 |

Soaking + Pretreatment + Cooking
In this method, Soaking is followed by pretreatment and then cooking.

It can be seen the results shown above, for Soaking and Cooking process are more encouraging for properties Burst Factor and Tensile Index whereas only Soaking increases the tear index but other properties are compromised in that particular process combination.

Soaking itself is a cost-effective process as the only thing required in that particular process is a holding tank made of PPFRP (Polypropylene Fibre Reinforced Plastic) and lower maintenance.

Though the recycle process require a certain amount of pentosan to be effective hence pretreatment with hot water at 130° C. is selected and the organosolv treatment is done after that.

Optimized Temperature and Pressure

For Soaking: Temperature=10-80° C., Pressure: 1-5 atm (Optimum: 25° C. at 1 atm)

For Pretreatment: Temperature=100-280° C., Pressure: Autogenous (Optimum: 130° C. at autogenous pressure (50 psi))

For Cooking: Temperature=120-180° C., Pressure: 10-200 psi (Optimum: 140° C. at 70 psi)

For Lignin Precipitation: Liquor to Water Ratio from 1:5 to 1:25; 1:10 Liquor to Water Ratio for optimum operating and cost-effective separation.

Example 3: Properties of Paper Prepared from the Pulp According to Process of the Present Invention Various processes and intermediate processes were studied, and the result can be tabulated in the form of properties of paper obtained from the particular processes. The major parameter for papers in packaging application which are taken in consideration for the current study are: Tensile Index, Burst Factor and Tear Index as shown below in Table 8.

TABLE 8

| Run | Component | S:L | Concentration | Temperature | Time | Kappa Number | Lignin(%) | Pentosan |
|---|---|---|---|---|---|---|---|---|
| R1 | DEG | 1:6 | 50 | 160 | 90 | 24.50 | 3.18 | 9.45 |
| R2 | DEG | 1:6 | 50 | 160 | 90 | 32.65 | 4.24 | 6.67 |
| R3 | DEG | 1:6 | 50 | 160 | 90 | 31.92 | 4.15 | 7.84 |
| R4 | DEG | 1:6 | 50 | 160 | 90 | 31.82 | 4.14 | 7.41 |
| R5 | DEG | 1:6 | 50 | 160 | 90 | 27.22 | 3.54 | 8.64 |
| R6 | DEG | 1:6 | 50 | 160 | 90 | 28.44 | 3.70 | 7.50 |

| Run | Recycle Liquor Composition |
|---|---|
| R1 | 47% DEG, 1.1% HMF, 1.9% Furfural, 50% $H_2O$ |
| R2 | 47% DEG, 1.0% HMF, 2.0% Furfural, 50% $H_2O$ |
| R3 | 47% DEG, 1.2% HMF, 1.8% Furfural, 50% $H_2O$ |
| R4 | 47% DEG, 1.0% HMF, 2.0% Furfural, 50% $H_2O$ |
| R5 | 47% DEG, 1.0% HMF, 2.0% Furfural, 50% $H_2O$ |
| R6 | 47% DEG, 1.0% HMF, 2.0% Furfural, 50% $H_2O$ |

The R's here are from the same run, whereas R1 is run of recycle, R2 run two of the same recycle loop and so on. As the disclosed process is a batch process the process parameters vary slightly but remains constant more or less.

Refer to Table 4 & Table 5 for Tensile Index, Burst Factor and Tear Index properties, if Recycle Liquor is not used or used with a composition outside the scope of present invention. As those iteration are independent of recycled liquor and are done with pure organic solvents.

Amount of Solvent Used

TABLE 9

| Recycle liquor | | | | |
|---|---|---|---|---|
| Total Solution for Cooking(grams) | Amount of DEG (grams) | Amount of Water (grams) | Amount of Pulp Obtained | Pulp obtained per unit glycol used |
| 600 | 300 | 300 | 336 | 1.12 |
| **Conventional Cooking** | | | | |
| Total Solution for Cooking(grams) | Amount of DEG (grams) | Amount of Water (grams) | Amount of Pulp Obtained | Pulp obtained per unit glycol used |
| 600 | 300 | 300 | 56 | 0.19 |

As evident from the Table 9 above the pulp obtained per unit DEG used in the process liquors has increased by almost 6% for the same amount of water and DEG used in a conventional process.

Amount of Silica Retained in Pulp

TABLE 8

| Raw Material-Rice Straw | Composition (%) | Weight (gm) |
|---|---|---|
| Ash | 17.48 | |
| Lignin | 13.25 | |
| Holocellulose | 51.95 | |
| Pentosan | 20.58 | |
| Silica | 10.75 | |
| | | 100 |
| **Pre-treatment (Water-Autohydrolysis)** | **Composition(%)** | **Weight (gm)** |
| Ash | 21.77 | |
| Lignin | 16.50 | |
| Holocellulose | 60.40 | |
| Pentosan | 10.10 | |
| Silica | 13.39 | |
| Yield | 80.3 | 80.3 |
| **Cooking (Recycle)** | **Composition(%)** | **Weight (gm)** |
| Ash | 25.5 | |
| Lignin | 5.174 | |
| Holocellulose | 69.33 | |
| Pentosan | 5.7 | |
| Silica | 16.28 | |
| Yield | 64.5 | 64.5 |

100 gm of biomass is taken and pre-treatment and cooking operation were performed and characterization of biomass was done at each processing step from raw material, pre-treatment and cooking for ash content, lignin, holocellulose, pentosan, and silica. It can be observed that the silica retained in the pulp is maximum when the recycle step is performed according to the method of the present disclosure.

Process for Treating Biomass According to the Disclosure.

100 grams of rice straw is taken from local fields and sized most preferably to 2.0 cm using a chaff cutter. The sized biomass is fed to the pretreatment vessel (flow through vessel with heating assembly and temperature controller) with water in 1:5 to 1:10 ratio i.e., 20 gm-2000 gm of water and treated to 130° C.-160° C. for 90 min in the reactor. The water is then drained, and the straw is mixed with recycle liquor with the composition EG/DEG/PG 50-100%, HMF 0.5-2%, Furfural 1-3%, and $H_2O$ 50-0%, in 1:6 to 1:10 ratio (R1), and treated at a temperature preferably in between 120-160° C. for 90 min. The cooked biomass is then sent to washer to wash spent liquor and separate the pulp, and the lignin precipitated out using a separation assembly. The permeate from the filter is stored in a vessel till the next batch takes place. The stored liquor is concentrated in evaporator and the liquor is sent back to pulping vessel for the next cycle (R2). The same steps are repeated for the consecutive cycles R3, R4 and R5 and the pulp obtained is checked for properties in each cycle to check for variation in the properties of pulp as shown in the following table Process Example 1

| Pretreatment | | | Cooking | | |
|---|---|---|---|---|---|
| Component | Temperature | S:L | Component | S:L | Temperature |
| Water | 130 | 1:6 | EG | 1:6 | 120 |

| Liquor Composition | | | | |
|---|---|---|---|---|
| Run | EG | HMF | Furfural | $H_2O$ |
| R1 | 48.0% | 2.0% | 3.0% | 47% |
| R2 | 47.9% | 2.0% | 3.1% | 47% |
| R3 | 47.7% | 2.1% | 3.2% | 47% |
| R4 | 47.9% | 2.0% | 3.1% | 47% |
| R5 | 47.8% | 2.0% | 3.2% | 47% |

| Run | Kappa Number | Pentosan | Burst Index | Tensile Index | Tear Index |
|---|---|---|---|---|---|
| R1 | 32.1 | 9.7 | 4.79 | 15.35 | 17.74 |
| R2 | 31.2 | 9.8 | 4.76 | 15.95 | 17.35 |
| R3 | 29.8 | 9.7 | 4.72 | 15.65 | 17.15 |
| R4 | 28.3 | 9.5 | 4.64 | 15.92 | 17.08 |
| R5 | 28.4 | 9.8 | 4.68 | 15.86 | 17.12 |

Process Example 2

| Pretreatment | | | Cooking | | |
|---|---|---|---|---|---|
| Component | Temperature | S:L | Component | S:L | Temperature |
| Water | 150 | 1:6 | EG | 1:6 | 120 |

| Liquor Composition | | | |
|---|---|---|---|
| EG | HMF | Furfural | $H_2O$ |
| 48.5% | 0.5% | 1.0% | 50% |

| Kappa Number | Pentosan | Burst Index | Tensile Index | Tear Index |
|---|---|---|---|---|
| 29.2 | 2.4 | 1.3 | 9.6 | 10.2 |

Process Example 3

| Pretreatment | | | Cooking | | |
|---|---|---|---|---|---|
| Component | Temperature | S:L | Component | S:L | Temperature |
| Water | 130 | 1:6 | DEG | 1:6 | 160 |

| Liquor Composition | | | |
|---|---|---|---|
| DEG | HMF | Furfural | $H_2O$ |
| 47.0 | 1.1 | 1.9% | 50% |

| Kappa Number | Pentosan | Burst Index | Tensile Index | Tear Index |
|---|---|---|---|---|
| 42 | 7.9 | 3.8 | 2.9 | 2.5 |

Process Example 4

| Pretreatment | | | Cooking | | |
|---|---|---|---|---|---|
| Component | Temperature | S:L | Component | S:L | Temperature |
| Water | 130 | 1:6 | DEG | 1:6 | 160 |

| Liquor Composition | | | |
|---|---|---|---|
| DEG | HMF | Furfural | $H_2O$ |
| 100.0 | 0% | 0% | 0% |

| Kappa Number | Pentosan | Burst Index | Tensile Index | Tear Index |
|---|---|---|---|---|
| 32.2 | 6.7 | 2.4 | 7.6 | 14.6 |

Process Example 5

| Pretreatment | | | | |
|---|---|---|---|---|
| Component | Temperature | S:L | S:L | Temperature |
| Water | 130 | 1:6 | 1:6 | 160 |

| Liquor Composition | | | |
|---|---|---|---|
| DEG | HMF | Furfural | $H_2O$ |
| 0% | 0% | 0% | 100% |

| Kappa Number | Pentosan | Burst Index | Tensile Index | Tear Index |
|---|---|---|---|---|
| 48.1 | 11.13 | 0.3 | 1.2 | 1.6 |

Process Example 6

| Pretreatment | | | Cooking | | |
|---|---|---|---|---|---|
| Component | Temperature | S:L | Component | S:L | Temperature |
| Water | 160 | 1:6 | DEG | 1:6 | 160 |

| Recycle Liquor Composition | | | |
|---|---|---|---|
| DEG | HMF | Furfural | $H_2O$ |
| 50% | 0% | 0.5% | 49.5% |

| Kappa Number | Pentosan | Burst Index | Tensile Index | Tear Index |
|---|---|---|---|---|
| 34.6 | 0.5 | 0.0 | 0.0 | 0.0 |

Product Example 1

The molded product obtained shows higher bursting strength and tensile index for high GSM paper boards and moulded packaging application. The extra silica provides rigidity to the material formed.

| Raw Material:Rice Straw | GSM | Burst Factor | Tensile Index | Remarks |
|---|---|---|---|---|
| 6% NaOH | 257 | 6.43 | 13.00 | Without Silica |
| DEG:WATER::50:50 | 260 | 12.22 | 15.32 | With Silica |

The advantages of the disclosed invention are thus attained in an economical, practical and facile manner. While preferred embodiments and example have been shown and described, it is to be understood that various further modifications and additional configurations will be apparent to those skilled in the art. It is intended that the specific embodiments herein disclosed are illustrative of the preferred and best modes for practicing the invention and should not be interpreted as limitations on the scope of the invention.

Advantages

Environmentally friendly
Cost-effective
High yield lignin

The invention claimed is:

1. A process for the treatment of biomass, comprising:

sizing of biomass followed by pre-treatment or optionally soaking and then pre-treating biomass, in a first reaction vessel so as to form a pre-treated biomass material;

squeezing and washing the pre-treated biomass material to remove a liquor 'A' followed by cooking in a second reaction vessel using a high boiling solvent A to provide a pulp, the high boiling solvent A comprising at least one solvent selected from the group consisting of di-ethylene glycol (DEG), ethylene glycol (EG), and propylene glycol (PG);

squeezing and washing the pulp using a hot high boiling solvent B at a temperature in a range from 140 to 200° C. in a counter current fashion to provide a black liquor, the hot high boiling solvent B comprising at least one solvent selected from the group consisting of di-ethylene glycol (DEG), ethylene glycol (EG), and propylene glycol (PG);

diluting the black liquor to precipitate lignin out and separating a supernatant liquor 'B';

the supernatant liquor 'B is collected and concentrated using an evaporator to form a concentrated liquor 'B', followed by recycling the concentrated liquor 'B' to the reaction vessel for cooking of the pretreated biomass along with the high boiling solvent B, wherein the biomass subsequent to soaking or pre-treatment is cooked in a recycled stream based on the concentrated liquor 'B', a mass ratio of the high boiling solvent B to water to hydroxymethylfurfural (HMF) to furfural in the recycled stream being in a range from 48:50:2:4 to 50:47:1:2, wherein the biomass is crop residue like selected from the group consisting of rice straw, wheat straw, husk, or combinations thereof, wherein the process is a batch process.

2. The process as claimed in claim 1, wherein the pre-treated biomass material is fed to the reaction vessel maintaining a 1:6 solid to liquid ratio wherein the liquid contains recycled stream based on the concentrated liquor 'B'.

3. The process as claimed in claim 1, wherein the solid to liquid ratio for soaking is maintained at a range of 1:5 to 1:15.

4. The process as claimed in claim 1, wherein the pre-treating of biomass is done using hot water at a temperature in a range from 120 to 200° C. after soaking or without soaking by feeding the biomass to the first reaction vessel along with hot water.

5. The process as claimed in claim 1, wherein the pre-treating of biomass using hot water at a temperature in a range from 120 to 200° C. is done in the ratio of 1:6 or 1:10 solid to liquid ratio for biomass and water respectively.

6. The process as claimed in claim 1, wherein the biomass subsequent to soaking or pre-treatment is cooked in the high boiling solvent A.

7. The process as claimed in claim 1, wherein the biomass is washed for dirt and other impurities before sizing to in a size range from 1.5 to 2.5 cm.

8. The process as claimed in claim 1, wherein the sized biomass is fed to a tank, in which the soaking is done with the presence of alkali, acid or organic solvent.

9. The process as claimed in claim 1, wherein the soaking comprises squeezing and washing the biomass material so as to remove the liquor 'A'.

10. The process as claimed in claim 1, wherein the pre-treated biomass material is fed to the second reaction vessel maintaining a 1:6 solid to liquid ratio wherein the liquid contains a particular weight ratio of the high boiling solvent A to the water ranging from 50:50 to 100:00 and at higher temperature ranging from 140 to 200° C.

11. The process as claimed in claim 1, wherein the pre-treated biomass material is fed to the second reaction vessel maintaining a 1:6 solid to liquid ratio, wherein a mass ratio of the DEG to the water to the HMF to the furfural in the recycled stream is 50:48:1:2.

12. The process as claimed in claim 1, wherein the supernatant liquor 'B' is stored in an intermediate tank for a next scheduled batch or is recycled to the cooking reaction vessel.

* * * * *